US010051883B2

(12) United States Patent
Xue et al.

(10) Patent No.: US 10,051,883 B2
(45) Date of Patent: Aug. 21, 2018

(54) INCORPORATION OF AMMONIA RELEASE COMPOUNDS IN SMOKING ARTICLES

(71) Applicant: Philip Morris USA Inc., Richmond, VA (US)

(72) Inventors: Lixin Xue, Midlothian, VA (US); W. Geoffrey Chan, Chesterfield, VA (US); Mohammad Hajaligol, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 79 days.

(21) Appl. No.: 14/054,311

(22) Filed: Oct. 15, 2013

(65) Prior Publication Data

US 2014/0041674 A1 Feb. 13, 2014

Related U.S. Application Data

(60) Continuation of application No. 13/240,565, filed on Sep. 22, 2011, now Pat. No. 8,555,897, which is a division of application No. 11/636,587, filed on Dec. 11, 2006, now Pat. No. 8,042,552.

(60) Provisional application No. 60/749,594, filed on Dec. 13, 2005.

(51) Int. Cl.

| | |
|---|---|
| ***A24F 47/00*** | (2006.01) |
| ***A24B 15/28*** | (2006.01) |
| ***A24B 15/24*** | (2006.01) |
| ***A24B 15/30*** | (2006.01) |
| ***A24B 15/42*** | (2006.01) |

(52) U.S. Cl.

CPC ..... *A24B 15/281* (2013.01); *A24B 15/246* (2013.01); *A24B 15/28* (2013.01); *A24B 15/30* (2013.01); *A24B 15/42* (2013.01)

(58) Field of Classification Search

None

See application file for complete search history.

(56) References Cited

U.S. PATENT DOCUMENTS

| | | | | |
|---|---|---|---|---|
| 2,227,863 | A | 1/1941 | Rhodes | |
| 2,525,785 | A | 10/1950 | Feinstein et al. | |
| 2,914,072 | A * | 11/1959 | Tyrer | A24B 15/42 131/309 |
| 3,251,365 | A | 5/1966 | Keith, II et al. | |
| 3,285,253 | A | 11/1966 | Lebert | |
| 3,355,317 | A | 11/1967 | Keith, II et al. | |
| 3,528,432 | A | 9/1970 | Stossel | |
| 3,782,393 | A * | 1/1974 | Michelson | A24B 15/243 131/334 |
| 4,022,223 | A | 5/1977 | Rainer et al. | |
| 4,123,592 | A | 10/1978 | Rainer et al. | |
| 4,125,118 | A | 11/1978 | Rudner | |
| 4,184,495 | A | 1/1980 | Rainer et al. | |
| 4,248,252 | A * | 2/1981 | Lendvay | A24B 3/182 131/293 |
| 4,266,562 | A | 5/1981 | Merritt et al. | |
| 4,274,427 | A | 6/1981 | Lendvay | |
| 4,628,947 | A | 12/1986 | Driscoll et al. | |
| 5,018,540 | A | 5/1991 | Grubbs et al. | |
| 5,053,540 | A * | 10/1991 | Cottman | C07C 209/52 552/301 |
| 6,289,898 | B1 | 9/2001 | Fournier et al. | |
| 6,440,223 | B1 | 8/2002 | Dube et al. | |
| 6,701,936 | B2 | 3/2004 | Shafer et al. | |
| 7,690,387 | B2 | 4/2010 | Fournier et al. | |
| 8,555,897 | B2 | 10/2013 | Xue et al. | |
| 2005/0000531 | A1 | 1/2005 | Shi | |
| 2005/0066986 | A1 * | 3/2005 | Nestor | A24D 1/00 131/364 |

OTHER PUBLICATIONS

International Search Report and Written Opinion dated Sep. 18, 2007 for PCT/IB2006/004115.

* cited by examiner

*Primary Examiner* — Michael J Felton
*Assistant Examiner* — Phu Nguyen
(74) *Attorney, Agent, or Firm* — Buchanan Ingersoll & Rooney PC

(57) ABSTRACT

A tobacco smoking mixture including an ammonia-release compound adapted to be formed into a lit-end cigarette is provided. The ammonia-release compound is incorporated in or on tobacco cut filler in an amount effective to reduce the cytotoxicity, and/or selective smoke constituents of cigarette smoke. Exemplary ammonia-release compounds include ammonium acetate, ammonium hydroxide, hexammine cobalt (III) chloride, hexammine cobalt (III) acetate, and combinations thereof. The ammonia-release compounds can release ammonia at temperatures between about 60° C. and about 400° C. Ammonia-release compounds can be combined with additives, such as glycerine, cobalt acetate, copper (II) acetate, zinc acetate, other metal salts or combinations thereof, to further reduce the cytotoxicity of cigarette smoke.

9 Claims, No Drawings

INCORPORATION OF AMMONIA RELEASE COMPOUNDS IN SMOKING ARTICLES

CROSS REFERENCE TO RELATED APPLICATIONS

This application is a continuation application of U.S. application Ser. No. 13/240,565 entitled INCORPORATION OF AMMONIA-RELEASE COMPOUNDS IN SMOKING ARTICLES, filed Sep. 22, 2011 which is a divisional application of U.S. application Ser. No. 11/636,587 entitled INCORPORATION OF AMMONIA-RELEASE COMPOUNDS IN SMOKING ARTICLES, filed on Dec. 11, 2006, which claims priority under 35 U.S.C. § 1191 to U.S. Provisional Patent Application No. 60/749,594, filed Dec. 13, 2005, the entire content of each is hereby incorporated by reference.

SUMMARY

Ammonia-release compounds for incorporation in or on tobacco such as cut filler are provided herein. By incorporating ammonia-release compounds in or on tobacco cut filler, the ammonia-release compounds can be uniformly distributed in a tobacco rod of a cigarette. Further, by using the ammonia-release compounds as disclosed herein, the ammonia can be made available within the cigarette for reaction with cytotoxic constituents.

In one embodiment, a smoking composition comprises tobacco and at least one ammonia-release compound incorporated in or on the tobacco, wherein the ammonia-release compound is present in an amount effective to reduce the cytotoxicity of cigarette smoke, wherein the at least one ammonia-release compound comprises ammonium hydroxide, ammonium acetate, hexammine cobalt (III) chloride, hexammine cobalt (III) acetate or combinations thereof.

In another embodiment, a cigarette comprises a tobacco rod, wherein the tobacco rod includes an ammonia-release compound in or on the tobacco rod in an amount effective to reduce the cytotoxicity of cigarette smoke, wherein the ammonia-release compound comprises ammonium hydroxide, ammonium acetate, hexammine cobalt (III) chloride, hexammine cobalt (III) acetate, or combinations thereof.

In another embodiment, a method of making a cigarette comprises: (i) incorporating an ammonia-release compound in a tobacco cut filler, wherein the ammonia-release compound comprises ammonium hydroxide, ammonium acetate, hexammine cobalt (III) chloride, hexammine cobalt (III) acetate, or combinations thereof; (ii) providing the tobacco cut filler to a cigarette making machine to form a tobacco column; (iii) placing a cigarette wrapper around the tobacco column to form a tobacco rod of a cigarette; and (iv) optionally attaching a cigarette filter to the tobacco rod using tipping wrapper.

In another embodiment, a method of reducing cytotoxicity in tobacco smoke, produced by a cigarette comprising tobacco and an ammonia-release compound incorporated in or on the tobacco, wherein the ammonia-release compound comprises ammonium hydroxide, ammonium acetate, hexammine cobalt (III) chloride, hexammine cobalt (III) acetate, or combinations thereof, comprises lighting the cigarette such that heat from the lit cigarette causes the ammonia-release compound to release ammonia in a distillation zone of the cigarette and the ammonia reacts with cytotoxic compounds within the distillation zone of the cigarette.

DETAILED DESCRIPTION

An ammonia-release compound is described herein for use with smoking articles such as lit-end cigarettes. The ammonia-release compound can introduce ammonia to the distillation zone of a cigarette in an amount effective to decrease the cytotoxicity and/or mutagenicity of the total particulate matter of cigarette smoke, as well as the phenolic and aromatic compound content formed during smoking (i.e., during combustion and/or pyrolysis of tobacco).

Cigarette smoke includes solid and gaseous phases (e.g., tar and gas-phase smoke). Combustion by-products can be produced in the combustion/pyrolysis regions of a cigarette during smoking (e.g., from tobacco combustion) and are typically present in both the solid and gaseous phases of cigarette smoke.

Release of cytotoxic constituents, such as phenolics and dihydroxybenzenes, and carbohydrate decomposition products of tobacco smoke, occur primarily in the distillation zone of a cigarette at temperatures of about 350° C. Due to the release of these constituents and products, ammonia can be made available within the distillation zone of the cigarette with the constituents and products as they are formed. In other words, by releasing ammonia where cytotoxic constituents are formed, the ammonia and the cytotoxic constituents can readily react in the distillation zone.

In order to incorporate ammonia-release compounds in or on tobacco cut filler, water-soluble ammonia-release compounds can be used. As tobacco cut filler is inherently hydrophilic (i.e., "water loving") and includes water therein, water-soluble ammonia-release compounds, can mix well with the tobacco cut filler. As used herein, the term "water-soluble" is intended to include compositions which readily dissolve in water and can remain dissolved in water for an extended period of time.

By providing water-soluble ammonia-release compounds, the ammonia-release compounds can be uniformly dispersed throughout the hydrophilic tobacco filler. If water-insoluble ammonia-release compounds are provided, they can be provided in a well-mixed aqueous slurry, for example, wherein the water-insoluble ammonia-release compounds can thereby be dispersed in tobacco cut filler.

The ammonia-release compounds preferably release ammonia for reaction under desired predetermined conditions. As such, ammonia-release compounds that have predictable releases can be utilized. Exemplary ammonia-release compounds include inorganic ammonium metal salts. By using selected inorganic ammonium metal salts, predictable releases can be achieved through thermal degradation. For example, some inorganic ammonium metal salts can release ammonia at elevated temperatures, such as between about 60° C. and about 400° C. (i.e., temperatures within the distillation zone).

In exemplary embodiments, the ammonia-release compounds are hexammine complexes of various transition metals. The class of hexammine complexes, which may coordinate up to 6 ammonia molecules per transition metal ion (e.g., cobalt, chromium or ruthenium), can release up to about 30% ammonia or more by weight. Hexammine complexes of cobalt, for example, can thermally degrade at temperatures of between about 60° C. and about 400° C.

In other exemplary embodiments, the ammonia-release compounds can include, but are not necessarily limited to, water-soluble ammonia release compounds, which release ammonia in or around the distillation zone of a cigarette (have decomposition temperatures of around 200° C. to around 400° C.). Exemplary water-soluble ammonia release compounds can include, but are not necessarily limited to inorganic ammonium metal salts (e.g., ammonium hydroxide ($NH_4OH$) and/or ammonium acetate ($NH_4OAc$)); metal hexammine complexes (e.g., hexammine cobalt (III) chloride ($Co(NH_3)_6Cl_3$) and/or hexammine cobalt (III) acetate ($Co(NH_3)_6$ $(OAc)_3$)); and combinations thereof.

These ammonia-release compounds can be combined with additives to further reduce toxicity. Exemplary additives include, but are not limited to glycerine, cobalt acetate ($Co(OAc)_2$), copper (II) acetate ($Cu(OAc)_2$), zinc acetate ($Zn(OAc)_2$), other metal salts, and combinations thereof, wherein these additives are preferably also water-soluble. Thus, exemplary additives can include ammonia-release compound additive combinations can include ammonium acetate and cobalt acetate; glycerine and ammonium acetate; or ammonium acetate and copper (II) acetate.

A tobacco smoking mixture including tobacco and ammonia-release compound can be formed into the tobacco rod of a cigarette. In a tobacco smoking mixture up to about 30 wt % ammonia-release compound based on the total weight of the tobacco smoking mixture can be used.

Cigarettes have temperature zones during smoking. First, there is a combustion zone, which is the burning zone of a cigarette usually from the lit end to the char line of the cigarette. The temperature in the combustion zone ranges from about 500° C. to about 1000° C.

Beyond the char line is the pyrolysis zone, which can be about 1 to 2 mm beyond the char line. In the pyrolysis zone, temperatures of about 400° C. to about 600° C. can be expected. Beyond the pyrolysis zone, the distillation zone, which lies beyond the pyrolysis zone about 2 mm and more beyond the char line is within the distillation zone. Temperatures of about 400° C. or less can be expected.

Within this distillation zone, it is believed that formation of a majority of the cytotoxic compounds in tobacco smoke occurs as a result of heating of tobacco to temperatures between about 200° C. and about 400° C. Ammonia-release compounds which release ammonia at about 60° C. to about 400° C. are desired in order to provide the ammonia during the formation of the majority of the cytotoxic compounds.

As mentioned above, exemplary ammonia-release compounds can be water-soluble in order to mix the ammonia-release compounds with tobacco cut filler during processing of the tobacco cut filler. For example, ammonium acetate can be dissolved in water, and then applied to tobacco cut filler through spraying the tobacco cut filler in a tumbling device. By providing water-soluble ammonia-release compounds in this manner, the tobacco cut filler can have ammonia-release compounds uniformly within the tobacco cut filler prior to forming the tobacco cut filler into tobacco rods for cigarette use. Water-insoluble ammonia-release compounds can be provided in a well-mixed aqueous slurry, for example, wherein the water-insoluble ammonia-release compounds can thereby be dispersed in tobacco cut filler.

A smoking mixture with tobacco and water-soluble ammonia-release compounds can be provided to form smoking articles. The smoking mixture can include up to about 30% by weight of the water-soluble ammonia-release compounds based on the total weight of the smoking mixture. The tobacco can function as fuel in the combustion and/or pyrolysis of the tobacco smoking mixture. Examples of suitable types of tobacco materials include flue-cured, Bright, Burley, Maryland or Oriental tobaccos, the rare or specialty tobaccos, and blends thereof.

The tobacco can be provided in the form of tobacco cut leaf filler, processed tobacco materials, such as volume expanded or puffed tobacco, processed tobacco stems, such as cut-rolled or cut-puffed stems, reconstituted tobacco materials or blends thereof. The tobacco can also include tobacco substitutes such as synthetic tobacco. Generally, the tobacco used to form a cigarette is aged.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inch to about 3.0 inch.

The tobacco smoking mixture may optionally include additives to improve various characteristics of the tobacco during smoking. For example, taste modifiers may be added to the tobacco smoking mixture to improve its flavor.

Additionally, burn additives may be used to impart desirable burn characteristics or to alter other characteristics of the tobacco. Examples of burn additives include sodium fumarate, sodium citrate, potassium citrate, potassium succinate, potassium monohydrogen phosphate, and potassium dihydrogen phosphate.

The tobacco smoking mixture may be manufactured using any suitable technique. The ammonia-release compound may be added to cut filler tobacco stock supplied to a cigarette-making machine or incorporated on a pre-formed tobacco column prior to wrapping a cigarette wrapper around the tobacco column. For example, according to one embodiment, a method for manufacturing the tobacco smoking mixture comprises the step of spraying tobacco with at least one ammonia-release compound. To facilitate spraying, the at least one ammonia-release compound can be added to a liquid carrier to form a slurry, and the slurry can be applied onto the tobacco. The tobacco smoking mixture can then be processed for use in a cigarette.

Slurries comprising an ammonia-release compound can comprise any liquid or liquid mixtures suitable for dispersing and dispensing (e.g., spraying) particles of the ammonia-release compound. A preferred liquid is water (e.g., deionized water), though other liquids, such as alcohols, can be used.

The concentration of ammonia-release compound in the slurry can be any amount suitable for dispensing the slurry onto tobacco. Slurries comprising a dispersion of ammonia-release compound in a liquid can comprise greater than about 1%, or greater than about 5% by weight of the ammonia-release compound.

Ammonia-release compounds can be provided in the form of a dried powder. If dried powder is used, it can be dusted onto tobacco and/or mixed with tobacco to form a smoking mixture, wherein moisture in the tobacco can allow the ammonia-release compound to be incorporated therein. For example, moistened tobacco cut filler or a slurry of reconstituted tobacco material can be dusted with a powdered ammonia-release compound prior to forming the tobacco smoking mixture into a tobacco rod, wherein the moisture can dissolve and diffuse the compound into the smoking mixture.

Another technique for incorporating an ammonia-release compound in a tobacco smoking mixture involves adding the ammonia-release compound to a slurry of ingredients used to make reconstituted tobacco. For example, an ammonia-release compound can be added to a reconstituted tobacco slurry in any suitable amount, wherein both the compound and the tobacco can be mixed together due to their water solubility.

The slurry, including the ammonia-release compound, can be formed into a reconstituted tobacco sheet and the sheet can be cut to shreds for incorporation as filler of a tobacco rod or other smoking article. Alternatively, the sheet can be formed, then shredded and added to tobacco rod filler material and the mixture formed into a tobacco rod.

In a further example, a mixed ammonia-release compound, e.g., a mixture or combination of two or more ammonia-release compound compositions with different ammonia temperature release ranges, can be used to broaden the temperature range at which the ammonia is released.

Although the ammonia-release compound is described herein as having a release temperature, the term "release temperature" can refer to one or more temperatures at which an ammonia-release compound will release ammonia. It is noted, however, that the ammonia-release compound may still operate to reduce the cytotoxicity of cigarette smoke and the total particulate matter generated via tobacco combustion outside the release temperature.

An embodiment relating to a method of making a cigarette which can include (i) incorporating an ammonia-release compound in a tobacco cut filler; (ii) providing the tobacco cut filler to a cigarette making machine to form a tobacco column; (iii) placing the cigarette wrapper around the tobacco column to form a tobacco rod of a cigarette; and (iv) optionally attaching a cigarette filter to the tobacco rod using tipping wrapper is provided. In cigarette production, a wrapper can be wrapped around cut filler to form a tobacco rod portion of a cigarette by a cigarette-making machine, which can be previously supplied or continuously supplied with tobacco cut filler and one or more ribbons of wrapper.

Any conventional or modified cigarette making technique may be used to incorporate one or more ammonia-release compounds into a cigarette. The cigarettes can be manufactured to any known specifications using standard or modified cigarette making techniques and equipment. The cut filler composition, for example, is optionally combined with other cigarette additives, and provided to a cigarette-making machine to produce a tobacco column, which is then wrapped in cigarette wrapper, and optionally tipped with filters.

The ammonia-release compound can be incorporated in tobacco cut filler in an amount effective to reduce the cytotoxicity of cigarette smoke and its contained smoke constituents by at least 5% (e.g., by at least 15%, 20%, 25%, 30%, 35%, 40%, 45%, 50%, 55%, 60%, 65%, 70%, 75%, 80%, 85%, 90% or 95%) compared to the smoke constituents of a control cigarette without the ammonia-release compound. For example, the amount of ammonia-release compound per cigarette can be about 10 to about 250 mg, or is about 50 to about 100 mg, wherein the lower limit is dictated by the effectiveness of the ammonia and the ammonia-release compound, and the upper limit is dictated by the amount that can be incorporated before changes to the smoking mixture's characteristics occur (e.g., a change in taste, etc.).

Cigarettes may range from about 50 mm to about 120 mm in length. The circumference is from about 15 mm to about 30 mm in circumference, and preferably around 25 mm. The tobacco packing density is typically between the range of about 100 mg/cm$^3$ to about 300 mg/cm$^3$, and preferably 150 mg/cm$^3$ to about 275 mg/cm$^3$.

Examples

In the examples listed in Table 1, ammonia-release compounds, such as ammonium hydroxide ($NH_4OH$ (6.8 g, 28-30% solution)), ammonium acetate ($NH_4OAc$ (4.3 g solid)) and hexammine-cobalt (III) chloride ($Co(NH_3)_6Cl_3$ (2.5 g, powder)), can be dissolved or suspended in water (20-40 g) and applied individually to separate batches of 40 g of tobacco filler in a tumbling device through a spraying or dropping nozzle to form tobacco samples. After equilibrating the tobacco samples in a conditioned room for 3 days, together with controlled samples that can be sprayed with water, the tobacco samples can be processed into handmade cigarettes with 5.0% $NH_4OH$, 10.8% $NH_4OAc$ or 6.3% $Co(NH_3)_6Cl_3$ as filler additive.

As shown in Table 1, a 48-62% reduction in hydroquinone (HQ) and about 20% reduction in benzo(a)pyrene (BaP) can be observed in the 3$^{rd}$ to the 4$^{th}$ puff, of the total particulate matter (TPM) from the smoke of the cigarettes with the addition of ammonia-release compounds. Additionally, significant reduction on TPM cytotoxicity can be observed in the three cases, while significant reduction in TPM mutagenicity can be observed for $Co(NH_3)_6Cl_3$. It is noted that the soluble $NH_3$-content in filler was increased from 0.11 to 0.53% after treating with 5.0% $NH_4OH$.

TABLE 1

Effects of $NH_3$-Containing Compounds as Filler Additives on MS TPM

| Samples | 10.8% $NH_4OAc$ | 6.3% $Co(NH_3)_6Cl_3$ |
|---|---|---|
| Compounds | | |
| phenol | −65% | −73% |
| o-cresol | −53% | −62% |
| m/p-cresol | −52% | −61% |
| catechol | −39% | −40% |
| HQ | −48% | −50% |
| resorcinol | −80% | −71% |
| Naphthalene | −32% | −47% |
| BaA | | |
| BaP | −19% | −23% |
| Cytotoxicity | −33% | −34% |
| Mutagenicity | −11% | −43% |

* Blank: No significant change (absolute change < 20%).
MS = mainstream smoke
TPM = total particulate matter The effects of $NH_4(OAc)_2$ treatment on smoke constituents is listed in Table 2. As shown in Table 2, the $NH_4(OAc)_2$ treatment showed little significant effect on TPM, tar, nicotine and water delivery per cigarette. However, the $NH_4(OAc)_2$ treatment showed significant reduction in formaldehyde, acrolein, n-nitrosonornicotine (NNN), phenol, o-cresols, benz(a)anthracene (BaA) and BaP per TPM levels. Thus, using $NH_4(OAc)_2$ can lead to significant reduction in certain smoke constituents.

TABLE 2

Effects of 10.8% $NH_4OAc$ on Smoke Constituents

| MS Components | Change |
|---|---|
| TPM/cig | 8% |
| Tar/cig | 8% |
| Nicotine/cig | 9% |
| Water/cig | 15% |
| Puff/cig | 30% |
| Carbonyl/TPM | |
| Formaldehyde | −77% |
| Acetaldehyde | −16% |
| Acetone | −3% |
| Acrolein | −30% |
| Propionaldehyde | −10% |
| Crotonaldehyde | −27% |
| MEK | 14% |
| Butyraldehyde | 9% |

TABLE 2-continued

| Effects of 10.8% $NH_4OAc$ on Smoke Constituents | |
|---|---|
| MS Components | Change |
| Volatile Organics/TPM | |
| 1,3-Butadiene | −3% |
| Isoprene | 3% |
| Benzene | 0% |
| Acrylonitrile | 14% |
| Toluene | 6% |
| Styrene | 7% |
| TSNA/TPM | |
| NNN | −26% |
| NNK | −19% |
| NAT | −4% |
| NAB | −16% |
| Phenols/TPM | |
| Hydroquinone | −11% |
| Resorcinol | n/a |
| Catechol | −8% |
| Phenol | −24% |
| p-Cresol | −18% |
| m-Cresol | −11% |
| o-Cresol | −21% |
| PAH/TPM | |
| B[a]A | −24% |
| B[a]P | −29% |

Difference is normalized by TPM weight for smoke constituents
cig = cigarette
MEK = methyl ethyl ketone The effects of the $NH_4(OAc)_2$ treatment on gas phase composition are shown in Table 3 as Fourier Transform Infrared (FT-IR) Gas Phase data together with gas vapor phase (GVP) toxicity data. As shown in Table 3, the $NH_4(OAc)_2$ can significantly lead to a 24% reduction in methanol/TPM and a 29% reduction in GVP toxicity, which is related to the reduction of smoke constituents such as formaldehyde and acrolein observed in Table 2.

$NH_4(OAc)_2$ in combination with other compounds, such as $Co(OAc)_2$, $Cu(OAc)_2$ and glycerine also show various reduction in smoke constituents. For example, the combination of $NH_4(OAc)_2$ and $Co(OAc)_2$ can lead to a reduction of HCN of about 37%, while the combination of $NH_4(OAc)_2$ and $Cu(OAc)_2$ can lead to a reduction of HCN of about 65%.

TABLE 3

| Effect of $NH_4(OAc)_2$ and $NH_4(OAC)_2$ Combinations as Filler Additives on MS Gas Phase Composition | | | | | | | |
|---|---|---|---|---|---|---|---|
| Additives | RTD | TPM | AA/ TPM | HCN/ TPM | MEOH/ TPM | COS/ TPM | GVP Toxicity |
| $NH_4(OAc)_2$ | 2% | 9% | | | −24% | | −29% |
| $NH_4(OAc)_2$/ $Co(OAc)_2$ | −4% | 2% | | −37% | | | N/A |
| $NH_4(OAc)_2$/ $Cu(OAc)_2$ | −15% | −5% | | −65% | | −54% | N/A |
| $NH_4(OAc)_2$/ Gly | −4% | 31% | −27% | | −43% | −28% | −45% |

*Blank: No Significant Change from control (Absolute Change <20%).
RTD = resistance to draw
TPM = total particulate matter
AA = acetyl aldehyde
HCN = hydrogen cyanide
MEOH = methanol
COS = carbonium sulfide
GVP = gas vapor phase
Gly = glycerine The effects of $NH_4(OAc)_2$ in combination with additives, such as glycerin and metal salts, on reducing TPM toxicity can is shown in Table 4. For example, as shown in Table 4, each of the additives, $Co(OAc)_2$, $Cu(OAc)_2$ and glycerin, in combination with $NH_4OAc$ appears to reduce the cytotoxicity and mutagenicity (as well as other compounds) to a greater extent than $NH_4OAc$ alone.

TABLE 4

| Effects of $NH_4OAc$ Combination Filler Additives on TPM Compositions and Toxicity | | | | |
|---|---|---|---|---|
| Compounds | $NH_4OAc$** | $Co(OAc)_2$/ NH4OAc | $Cu(OAc)_2$/ NH4OAc | Gly/ $NH_4OAc$ |
| Cigarette/g | 11% | 9% | 6% | 12% |
| Filler/g | 14% | 11% | 7% | 15% |
| phenol | −41% | −50% | −37% | −72% |
| o-cresol | −33% | −44% | −39% | −65% |
| m/p-cresol | −31% | −44% | −37% | −66% |
| catechol | −32% | −46% | | −46% |
| HQ | −25% | −38% | −20% | −53% |
| resorcinol | −52% | −47% | | −55% |
| Naphthalene | −37% | −45% | −23% | −49% |
| Fluorene | −24% | −46% | −33% | −46% |
| Phenantrene | −22% | −26% | −34% | −31% |
| Anthracene | −23% | −40% | −33% | −37% |
| Fluoranthene | | −25% | −37% | −28% |
| Pyrene | −28% | −36% | −55% | −35% |
| BaA | −25% | −36% | −35% | −24% |
| Chrysene | −21% | −23% | −25% | −23% |
| BaP | −23% | −30% | −41% | −17% |
| Cytotoxicity | −26% | −44% | −36% | −53% |
| Mutagenicity | 9% | −33% | −5% | −4% |

*Blank => No significant change (absolute value < 20%)
**Filler Treatment was Scale up to 300 g/Batch As shown in Tables 1-4, $NH_4OAc$ and related $NH_3$-containing additives, with or without additional additives, added to tobacco filler can significantly reduce formaldehyde, acrolein, NNN, phenol, o-cresol, BaA and BaP in mainstream smoke, as well as smoke GVP and TPM toxicity without changing the tar, nicotine and water delivery of the mainstream smoke.

TABLE 5

| Effects of $Co(NH_3)_6(OAc)_3$ on TPM Composition and Toxicity* | | |
|---|---|---|
| Compounds | $Co(NH_3)_6(OAc)_3$ | $Co(NH_3)_6(OAc)_3$/Gly |
| phenol | −25% | −77% |
| o-cresol | −30% | −73% |
| m/p-cresol | −18% | −71% |
| catechol | −30% | −56% |
| HQ | −18% | −60% |
| Fluorene | −20% | −50% |
| Phenantrene | −16% | −41% |
| Anthracene | −22% | −47% |
| Fluoranthene | −17% | −37% |
| Pyrene | −39% | −54% |
| BaA | −21% | −65% |
| Chrysene | −23% | −51% |
| BaP | −28% | −71% |
| Cytotoxicity | −24% | −45% |
| GVP Toxicity | −42% | −29% |

*Co and $NH_3$ level was 1.3% and 2.4% respectively. Glycerin level was 10%.

In Table 5, a first solution of 3.68 of $Co(NH_3)_6(OAc)_3.3H_2O$ was dissolved in 20 g of deionized water and sprayed on 40 g of tobacco filler; and a second solution of 4.0 g of glycerin was dissolved together with the 3.68 of $Co(NH_3)_6(OAc)_3.3H_2O$ in 20 g of deionized water was also sprayed on 40 g of tobacco filler in the same manner. Additionally, a control filler was sprayed with 20 g of deionized $H_2O$.

Next, the sprayed fillers were dried, conditioned and processed into handmade cigarettes. As shown in Table 5, the $Co(NH_3)_6(OAc)_3.3H_2O$ first solution and the $Co(NH_3)_6(OAc)_3.3H_2O$ combination with glycerin second solution showed significant reduction in not only the phenolic compounds and polyaromatic constituents, but also the TPM and GVP toxicity of cigarette smoke.

While various embodiments have been described, it is to be understood that variations and modifications may be resorted to as will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A smoking article comprising:

a single rod of tobacco;

an ammonia-release compound comprising ammonium hydroxide, and an additive selected from cobalt acetate, copper acetate, zinc acetate, or a combination thereof, wherein tobacco cut filler is uniformly distributed throughout the rod of tobacco;

wherein the ammonia-release compound and the additive are incorporated in or on the tobacco in an amount effective to reduce the cytotoxicity of smoke produced during combustion of the tobacco;

wherein the ammonia-release compound comprises an amount of up to about 30% by weight based on a total weight of the tobacco and the ammonia-release compound, and wherein the smoking article comprises at least about 50 mg of the ammonia-release compound.

2. The smoking article of claim 1, wherein the ammonia-release compound is adapted to release ammonia in a distillation zone of the smoking article.

3. The smoking article of claim 1, wherein the ammonia-release compound releases ammonia at a temperature between about 60° C. and about 400° C.

4. The smoking article of claim 1, wherein the ammonia-release compound is incorporated in or on tobacco cut filler in the rod of tobacco.

5. The smoking article of claim 4, wherein (a) the smoking article comprises glycerine incorporated in or on the tobacco cut filler in the rod of tobacco or (b) the ammonia-release compound is uniformly distributed throughout the tobacco cut filler in the rod of tobacco.

6. The smoking article of claim 1, wherein the ammonia-release compound comprises particles smaller than about 10 microns.

7. The smoking article of claim 1, wherein the ammonia-release compound is present in an amount effective to reduce phenolic and/or polyaromatic compounds in the smoke produced by the smoking article.

8. The smoking article of claim 1, wherein the additive is zinc acetate.

9. The smoking article of claim 1, wherein the smoking article comprises at least about 100 mg of the ammonia-release compound.

* * * * *